US006886759B1

(12) United States Patent
Okronick et al.

(10) Patent No.: US 6,886,759 B1
(45) Date of Patent: May 3, 2005

(54) WATER MISTING UMBRELLA

(76) Inventors: Andrew Okronick, P.O. Box 70305, Reno, NV (US) 89570; Jeffrey Lewis, P.O. Box 70305, Reno, NV (US) 89570

( * ) Notice: Subject to any disclaimer, the term of this patent is extended or adjusted under 35 U.S.C. 154(b) by 285 days.

(21) Appl. No.: 10/064,657

(22) Filed: Aug. 3, 2002

Related U.S. Application Data

(60) Provisional application No. 60/309,860, filed on Aug. 3, 2001.

(51) Int. Cl.[7] ..... B05B 15/00
(52) U.S. Cl. ..... 239/289; 239/16; 239/373
(58) Field of Search ..... 239/16, 17, 373, 239/289

(56) References Cited

U.S. PATENT DOCUMENTS

| | | | | | |
|---|---|---|---|---|---|
| 1,020,071 | A | | 3/1912 | Askin | |
| 2,727,366 | A | | 12/1955 | Hagen | 62/139 |
| 2,941,695 | A | | 6/1960 | Rich | 222/132 |
| 3,893,467 | A | * | 7/1975 | Wingen | 135/25.1 |
| 3,960,162 | A | * | 6/1976 | Noel | 135/33.7 |
| 5,000,384 | A | | 3/1991 | Arnold | 239/128 |
| 5,143,107 | A | | 9/1992 | Kelley | 135/16 |
| 5,535,951 | A | | 7/1996 | Utter | 239/322 |
| 5,620,140 | A | | 4/1997 | Utter | 239/153 |
| 5,622,056 | A | | 4/1997 | Utter | 62/121 |
| 5,775,590 | A | | 7/1998 | Utter | 239/152 |
| 5,967,415 | A | | 10/1999 | Utter | 239/152 |
| 5,979,793 | A | | 11/1999 | Louis | 239/128 |
| 6,017,188 | A | | 1/2000 | Benton | 416/5 |
| 6,112,538 | A | | 9/2000 | Strussion | 62/304 |
| 6,682,000 | B1 | * | 1/2004 | Apple | 239/289 |

* cited by examiner

*Primary Examiner*—Christopher Kim
(74) *Attorney, Agent, or Firm*—Kenehan & Lambertsen, Ltd.; John C. Lambertsen

(57) ABSTRACT

A personal misting umbrella consists of a water distribution tubing network that exists within the umbrella canopy. Its placement within and attachment to the spreader and rib umbrella canopy support structure enables the canopy to be operated in an unhindered manner within its stored and unfurled configurations as required by the user. Upon connection of the water distribution tubing network to a source of pressurized water, such as a personalized container-air pump combination, the user can selectively fill the canopy with a fine water mist, cooling the shaded air beneath the canopy through evaporative cooling.

13 Claims, 3 Drawing Sheets

WATER MISTING UMBRELLA

CROSS REFERENCE TO RELATED APPLICATIONS

This application claims the benefit of U.S. Provisional Patent Application No. 60/309,860, filed Aug. 3, 2001.

BACKGROUND OF INVENTION

1. Field of the Invention

The present invention related to evaporative cooling equipment and, more particularly, to an evaporative cooler for cooling individuals using a portable liquid misting device. More specifically, the present invention relates to a misting system mounted within a conventionally collapsible, hand carried sun umbrella.

2. Description of the Prior Art

The western portion of the United States, extending from West Texas to the California coastal range, is characterized by warm to hot summers, with generally low relative humidity. This climate has made the west ideal for evaporative or "swamp" coolers, which release water into the air to obtain a 10 to 20 degree reduction in air temperature.

Swamp coolers use considerably less power than compressive refrigeration units, and may be obtained in sizes ranging from the portable to units designed to cool individuals, such as spectators at summer sporting events, to massive, permanently mounted chillers for cooling buildings as large as aircraft hangers. As long as the air remains dry, such coolers can provide relief from the hottest days of summer at a fraction of the power requirements of refrigeration coolers.

Evaporative coolers typically employ a fan that is used to blow air through a wet, porous media. In a variation on that principal, the fans are eliminated and nozzles spray water droplets out into the atmosphere, permitting the general air circulation to cool the area surrounding the misting nozzles. These devices have become known as "misters," and were originally located in commercial areas such as outdoor restaurants and stadium event seating. Less costly pumping units have made "misters" available to homeowners for cooling covered outdoor patio areas.

More recently, personal misters have been provided that consist of a portable water carrier connected to one or more nozzles through flexible tubing. A hand-operated pump is provided to pressurize the container, and a control valve enables the user to cause water to flow from the tank and out through the nozzle. Since the water is under pressure as it leaves the nozzle, it is converted into a fine spray that is intended to evaporate and cool the air surrounding the user. Just as the original misters were located in shaded areas, a need exists to combine the cooling benefits of evaporating water droplets with a means to block the radiant energy of the sun during the hot days of summer.

SUMMARY OF INVENTION

It is an object of the present invention to provide a portable evaporative cooling system for use by individuals that combines the benefits of shading the user(s) from direct solar radiation, while also lowering the temperature of the immediate environment through evaporation. In this regard, a conventional umbrella is provided with several misting or spray nozzles that are attached and arranged on the underside of the canopy to create arrays of spray underneath the umbrella.

Depending upon humidity levels, by rotating the umbrella a user can vary the nature of cooling received, whether primarily by impact of liquid water or as a result of evaporative cooling in the user's immediate area. Water is transported to the nozzles through tubing that may be routed up through the inside of the umbrella shank. Storage of the water desirably may be using portable containers that permit pressurization and a controllable plastic tubing connection.

In use, after filling the water container, it is pressurize using a manual pump that is either an integral part of the container or an easy add-on to the container feed opening. A flexible tube connects the container to the umbrella supply tubing, with a control valve regulating the flow of water through this connection. When the valve is opened, permitting pressurized water to flow out of the container, the umbrella tubing directs the water up the shank and out through the nozzles mounted under the canopy. The nozzles can be directed to create a desired spray pattern, with simple rotation of the umbrella all that is required by the user to alter the effects of this spray pattern with respect to the user whether a physical wetting is desired or merely cooling as a result of the evaporation of an adjacent liquid spray.

These objects, as well as other objects and advantages of the present invention will become readily apparent upon review of the description of a non-limiting illustrative embodiment and the accompanying drawings.

DETAILED DESCRIPTION

Figure 1:
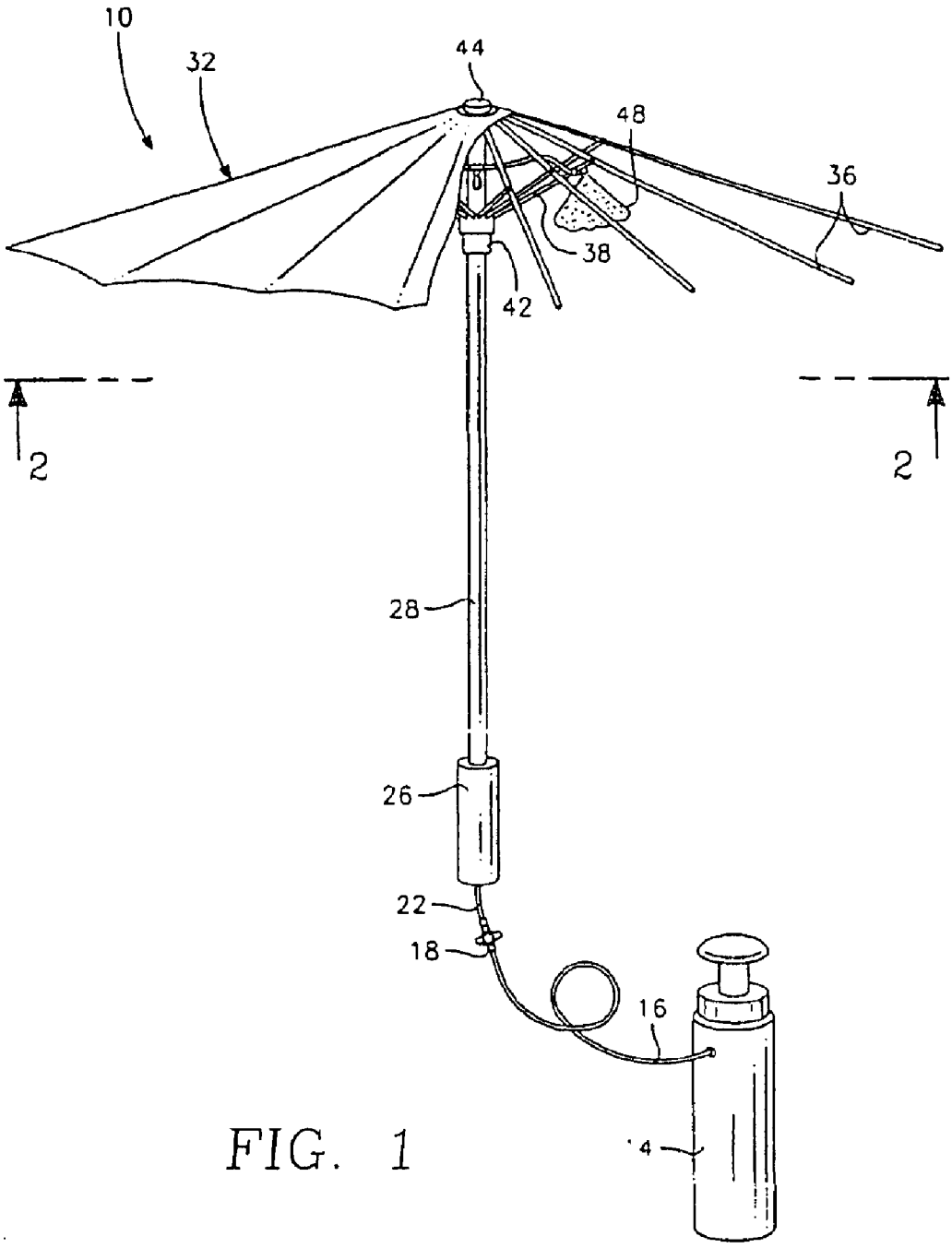
FIG. 1 is a perspective view, with portions broken away, showing a misting umbrella in accordance with the present invention.

Reference is now made to the drawings, wherein like numerals refer to like parts throughout. A misting umbrella 10 is shown in FIG. 1 in an opened configuration, with a water reservoir 14 connected to the misting umbrella 10 through a length of water supply tubing 16. A quick connect valve 18 permits fluid communication between the water supply tubing 16 and a length of transport tubing 22 that projects from a base of an umbrella handle 26.

The transport tubing 22 preferably lies within an umbrella shank 28 (which is conventionally a segment of metal tubing), and extends from the umbrella handle 26 to the umbrella canopy 32. In a conventional manner, the canopy 32 consists of a fabric or other material that is attached to and supported by a plurality of ribs 36 that extend in a spoke-like manner from an upper end of the umbrella shank 28.

The plurality of ribs 36 pivot from their attachment location on the umbrella shank 28, between a closed or stored position in which the ribs 36 are substantially parallel to the shank 28 (not shown in the drawings) to an unfurled position in which the ribs 36 are substantially perpendicular to the shank 28 when the canopy 32 is fully extended. A plurality of spreaders 38 position the canopy, with each attached to a separate one of the plurality of ribs 36 on one end and on the other, to a ring 42 that is slidably received by the shank 28. A reciprocating movement of the ring 42, up and down the shank 28, results in the opening and closing of the canopy 32. A cap button 44 is centrally positioned within the canopy 32, overlying the shank 28 to provide surface continuity at the attachment location for the ribs 36.

Figure 2:
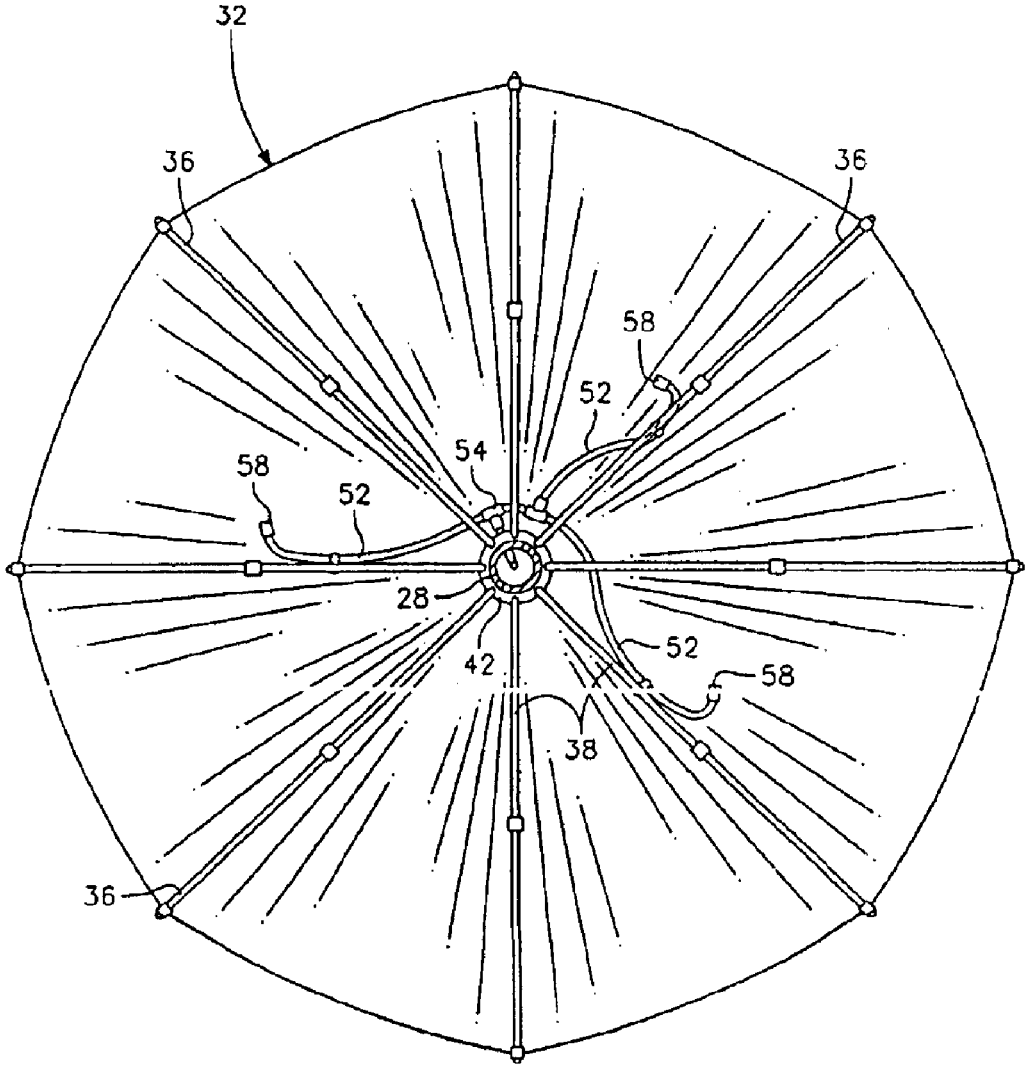
FIG. 2 is a cross-sectional view, taken along line 2—2 in FIG. 1, showing the manner of nozzle within the misting umbrella in accordance with the present invention.

A water droplet mist 48 is shown in FIG. 1, formed beneath the canopy 32. The underlying distributional structure required to transport the water from the water reservoir 14 and produce the mist 48 is shown in FIG. 2. A distribution-tubing network 52 extends from a centrally positioned transport connector 54, and terminates in a plurality of nozzles 58.

Figure 2A:
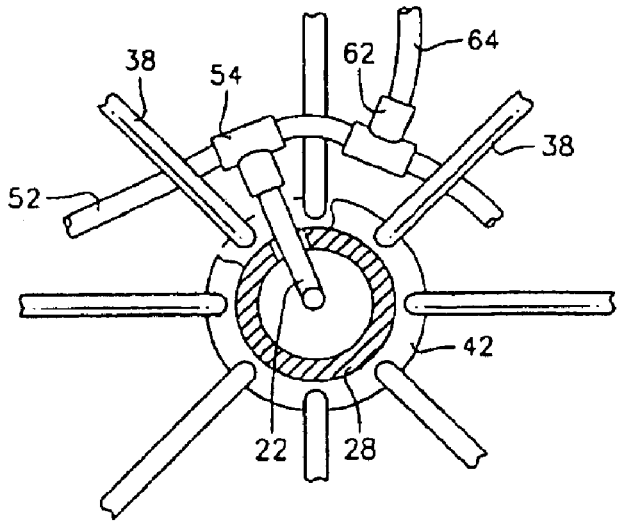
FIG. 2A is an enlarged cross-sectional view of the central umbrella canopy of FIG. 2, showing a connection between the water supply tubing and the distributional tubing in accordance with the present invention.

As is best depicted in FIG. 2A, the transport connector 54 attaches the distribution-tubing network 52 to the transport tubing 22, and thus to the source of water supply. One or more feeder connectors 62 (only one shown in FIG. 2A) may be used to attach feeder tubing 64 to the distribution-tubing network 52 to enable the provision of additional nozzles 58 under the umbrella canopy 32.

Figure 3:
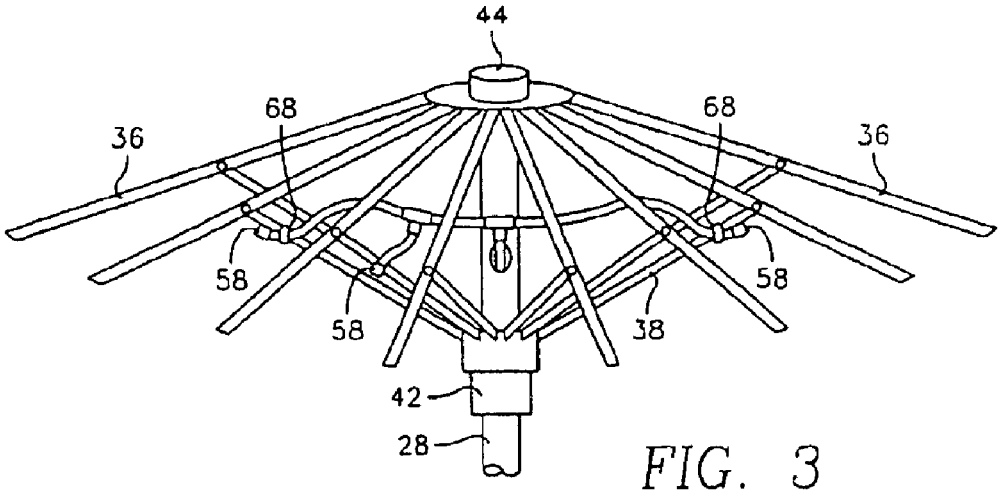
FIG. 3 is a partial perspective view, with portions broken away, showing the water distributional tubing beneath the umbrella canopy in accordance with the present invention.

Turning now to FIG. 3, a plurality of attachment bands 68 are utilized to arrange and attach the distribution-tubing network 52 among several individual spreaders 38. Preferably, these attachment locations are substantially adjacent to the nozzles 58 to more securely position the nozzles 58, and thus provide greater directional control over the water droplet mist 48 (not shown in FIG. 3). Additionally, although three nozzles 58 are depicted in FIG. 3, this number can vary, depending upon a number of design factors, such as the size of the umbrella and the climate in which the umbrella will be used.

The manner of operation for the misting umbrella 10 is best explained with reference to FIG. 1. Water is placed within the water reservoir 14, and pressurized using an internal pump provided for that purpose. The water supply tubing 16 is connected to the transport tubing 22 at the quick connect valve 18, making the water available to the misting umbrella 10.

Initiation of water flow can be accomplished by a valve arrangement in the quick connect valve 18, or by a separate valve (trigger, push-button, battery operated, etc.) that is attached to the umbrella itself (not shown in the drawings). Once initiated, water flows through the transport tubing 22, into the distribution tubing network 52 (identified in FIG. 2), and out through one or more of the nozzles 58. While the misting nozzles 58 can be turned in many different directions, the most satisfying appears to be one that is level, or slightly pointing upward, into the canopy. As so arranged, the canopy fills with a fine water mist, which then gently floats down upon the user under the influence of gravity. Light breezes can add a pleasant swirling motion to this mist.

When utilizing a portable water reservoir, as is depicted in FIG. 1, practical considerations of weight suggest the desirability of intermittent use of the misting system. However, in more permanent locations, such as patio or poolside umbrellas, a larger water supply permits more or less continuous use during hot periods of the day. Even where the water supply is limited, individual nozzles can be provided with a shut off device, permitting the user to limit the number of mist-creating nozzles where temperature conditions warrant.

When finished, the water valve is shut off and the water supply tubing 16 is disconnected from the quick connect valve 18. If there is a one-way valve feature in the quick connect valve 18, there is no leaking upon tubing separation, and a bleeding operation can empty any remaining water within the umbrella at a suitable location for disposing of the wastewater. The umbrella can then be folded in a conventional manner, and secured for storage.

In a preferred embodiment, the misting umbrella 10 makes use of an umbrella of substantially conventional design, having a canopy diameter of one to eight feet when opened, with a shank of approximately one to eight feet long. The water reservoir holds approximately 10–100 fluid ounces, and is attached to the umbrella using a water supply tubing 16 fabricated out of a plastic or rubber material of thickness ⅛ inch and of a sufficient length for the umbrella dimensions.

The transport tubing 22 may also be fabricated out of plastic or rubber, and is conveniently received within the umbrella shank 28. Such tubing has a diameter of ⅛to 1 inch and a length as required by the distribution network required. This same tubing is preferably used for the distribution-tubing network 52, with the nozzles of a conventionally available variety having an appropriate flow rate for the desired application.

While the foregoing depicts a misting system within an umbrella, it should be appreciated that the present invention also provides a temporary water misting system for use in a variety of other locations. Such a system may be temporarily installed in a covered golf cart, the canvas or fabric roofs of jeeps® and other all terrain vehicles, boats, trailers, and the like. The present invention provides a misting system that is portable, removable, and extremely versatile with respect to placement locations.

Our invention has been disclosed in terms of a preferred embodiment thereof, which provides an improved misting umbrella that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A portable misting umbrella comprising:

a portable umbrella having a reciprocating canopy with an inner and an outer surface, and a shank attached to said canopy at a central location on said inner surface thereof, said shank terminating in a handle and said canopy selectively reciprocating between a stored position adjacent said shank and an unfurled position;

a distribution tubing network attached to said inner surface or said canopy;

at least one spray nozzle attached to and in fluid communication with said distribution tubing network;

a fluid supply tubing in fluid communication with said distribution tubing network;

a plurality of ribs pivotally attached to said shank and extending therefrom, each of said ribs individually attached to said canopy at an extended location from said shank;

a ring slidably received by said shank; and a plurality of spreaders, each of said plurality of spreaders attached to a separate one of said plurality of ribs and extending to a location of attachment on said ring, and wherein said distribution tubing network is attached to at least one of said plurality of spreaders.

2. The portable misting umbrella of claim 1, wherein said distribution tubing network is attached to multiple ones of said plurality of spreaders.

3. The portable misting umbrella of claim 2, wherein a plurality of spray nozzles are individually attached to and in fluid communication with said distribution tubing network.

4. The portable misting umbrella of claim 1, wherein said shank comprises a hardened tube that defines an interior aperture, said fluid supply tubing received within said interior aperture and extending therein a substantial length of said shank.

5. The portable misting umbrella of claim 4, wherein a length of said fluid supply tubing extends from said handle, and further comprising a quick connect valve attached to said extending length of said fluid supply tubing at a terminus thereof.

6. The portable misting umbrella of claim 5, and further comprising a supply of pressurized water releasably connected to said quick connect valve.

7. The portable misting umbrella of claim 6, wherein said supply of pressurized water comprises a water container and a manual air pump in fluid communication with said water container, said water container including means for adding water thereto.

8. A misting umbrella, which comprises:

a canopy;

a shank attached to said canopy and extending therefrom and terminating in a handle;

a water distribution tubing network supported by both said shank and said canopy, said water distribution tubing network terminating in a plurality of spray nozzles directed in a manner that is substantially co-planar with said canopy when said canopy is in an unfurled configuration;

a fine water mist filling said canopy upon a pressurized discharge of a quantity of water from each of said plurality of spray nozzles;

a plurality of ribs pivotally attached to said shank and extending therefrom, each of said ribs individually attached to said canopy at an extended location from said shank;

a ring slidably received by said shank; and a plurality of spreaders, each of said plurality of spreaders attached to a separate one of said plurality of ribs and extending to a location of attachment on said rings, and wherein said water distribution tubing network is attached to at least one of said plurality of spreaders.

9. The portable misting umbrella of claim 8, wherein said water distribution tubing network is attached to multiple ones of said plurality of spreaders.

10. The portable misting umbrella of claim 8, wherein said shank comprises a hardened tube that defines an interior aperture, and further comprising a fluid supply tubing received within said interior aperture and extending therein a substantial length of said shank, said fluid supply tubing connected at a first end to said water distribution tubing network.

11. The portable misting umbrella of claim 10, wherein a length of said fluid supply tubing extends from said handle, terminating at a second end, and further comprising a quick connect valve attached to said fluid supply tubing at said second end.

12. The portable misting umbrella of claim 11, and further comprising a supply of pressurized water releasably connected to said quick connect valve.

13. The portable misting umbrella of claim 12, wherein said supply of pressurized water comprises a water container and a manual air pump in fluid communication with said water container, said water container including means for adding water thereto.

* * * * *